US005787717A

United States Patent [19]

Bang

[11] Patent Number: 5,787,717

[45] Date of Patent: Aug. 4, 1998

[54] SUCTION INLET/DISCHARGE OUTLET OPENING AND CLOSING APPARATUS FOR AN AIR CONDITIONER AND METHOD THEREFOR

[75] Inventor: Yong-Woong Bang, Sungnam, Rep. of Korea

[73] Assignee: Samsung Electronics Co., Ltd., Suwon, Rep. of Korea

[21] Appl. No.: 901,720

[22] Filed: Jul. 28, 1997

[30] Foreign Application Priority Data

Aug. 3, 1996 [KR] Rep. of Korea ..... 1996-38003

[51] Int. Cl.[6] ..... F25B 49/02

[52] U.S. Cl. ..... 62/89; 62/157; 62/180; 62/131; 165/122; 318/650

[58] Field of Search ..... 62/131, 180, 89, 62/262, 186, 265, 126, 129, 130, 157, 158, 231, 408, 409, 419, 426, 428; 454/239, 236, 256, 257, 258; 165/122; 318/563, 565, 466, 468, 626, 650

[56] References Cited

U.S. PATENT DOCUMENTS 2,724,245 11/1955 Swinburne ..... 62/419 X
5,341,650 8/1994 Nagasawa et al. ..... 62/180
5,461,875 10/1995 Lee et al. ..... 62/131 X
5,675,976 10/1997 Tobi et al. ..... 62/180

*Primary Examiner*—Harry B. Tanner
*Attorney, Agent, or Firm*—Burns, Doane, Swecker & Mathis, L.L.P.

[57] ABSTRACT

This invention relates to a suction inlet/discharge outlet opening or closing apparatus for an air conditioner having a function to close a suction inlet and a discharge outlet at the time of recovery of electric power, with reference to a time duration retrieved from an appropriate storage containing the time duration counted during a closing/opening of the suction inlet and discharge outlet, and a method therefor. The apparatus includes a voltage sensing unit for detecting input voltage varied during an opening or closing of the suction inlet and discharge outlet, a control unit for determining whether or not power failure occurs and, based upon the input voltage sensed by the voltage sensing unit, for controlling the opening or closing of the discharge outlet door and suction grille, a memory unit for memorizing the time interval for an opening or closing of the discharge outlet door and suction grille before the power failure occurs, and a driving unit adapted to move the discharge outlet door and suction grille only for the time interval stored in the memory means such that the discharge outlet and suction inlet are fully closed.

7 Claims, 11 Drawing Sheets

SUCTION INLET/DISCHARGE OUTLET OPENING AND CLOSING APPARATUS FOR AN AIR CONDITIONER AND METHOD THEREFOR

BACKGROUND OF THE INVENTION

1. Field of The Invention

The present invention relates to an air conditioner having a suction inlet/discharge outlet opening or closing apparatus which memorizes an opening or closing duration of a suction inlet and discharge outlet until power failure occurs and uses the stored one to again close the suction inlet and discharge outlet when the electric power is recovered again, and a method therefor.

2. Description of The Prior Art

A conventional air conditioner has, as shown in FIG. 1, a main body 1, a suction grille member 5 having suction inlets 3 arranged at the bottom portion of a front face of the body 1 to suck room air, and a discharge outlet 7 for discharging indoors the air heat-exchanged by a heat-exchanger with cold or warm air. The outlet is located at an upper portion of a front face of the body 1.

The discharge outlet 7 has blades 9 and 11 for horizontally and vertically directing the air to be discharged indoors therethrough, respectively. Also, there is provided a discharge outlet door 13, usually designed to give a good appearance. The door is installed upon a front face to open the discharge outlet 7 and to close the discharge outlet 7 for preventing dust or foreign substances from passing through the discharge outlet 7 and into the main body 1 during the standby mode of the air conditioner.

Further, there is provided a cover member 15 attached to the body 1 and usually designed to give a good appearance thereto and for protecting the interior thereof. Below the cover member 15 a manual manipulating portion 17 is arranged for any desired operation modes of the air conditioner such as automatic mode, cooling, heating, defrost, air-cleaning, and so forth, as well as the start/stop of the air conditioner, and for desirously defining the air amount and air flow directions discharged through the discharge outlet 7.

As shown in FIG. 3, driving means to vertically move the discharge outlet door 13 includes a supporting member 19 attached to an upper front surface of the body 1, and a door motor 21 fixed to the supporting member 15, for moving upward or downward the discharge outlet door 13. A pinion 23 is axially coupled to a shaft of the door motor 21 to be rotated during the motor 17 action. A rack 25 is mounted on the door for changing a rotary motion of the pinion 19 into a straight linear motion necessary for vertically moving the discharge outlet door 13 when the pinion 19 is rotated.

The driving means further includes another motor 27, which may be for example a stepping motor, installed within the body 1, and link members 29 adapted to vertically rotate a set of blades 9, simultaneously, by the motor 27.

For the conventional air conditioner thus constructed, if a user selects a desired operational mode through a remote controller or a manual manipulating portion 17 and then depresses the start/stop key (hereinafter referred to as an operation key), a door motor 21 is rotated in the forward direction to thereby rotate the pinion 23 axially coupled to the shaft 22 of the door motor 21, so that a down movement of the rack 25 caused by the pinion 23 moves downward the discharge outlet door 13, and the discharge outlet 5 is thus opened.

At this time, when the door opening/closing detection sensors, located at both upper and lower portions of the discharge outlet door 13 detect a full open condition of the discharge outlet 7, the door motor 21 stops, followed by a rotation of an indoor fan (not illustrated) to take the room air into the body 1 through the suction inlet 3. Then, the room air introduced into the body 1 through the suction inlet 3 is heat-exchanged by the evaporating latent heat of the refrigerant flowing into the heat-exchanger.

The air heat-exchanged through the heat-exchanger is guided into the upper portion of the body 1 and then discharged indoors according to the air blow designated by the controlled displacement of the blades 9, 11 for accomplishing the conditioning of the room air.

The vertical blades 9 are used to vertically adjust the air flow direction, which is accomplished by vertical swing the blade 9 by the associated link members 29 when the motor 27 is driven, caused by an activation of an operation key for the blades 9, and stopping the blade 9 when the motor 27 is deactivated with the key reactivated.

If the operation key is OFF during a normal operation of the air conditioner, the door motor 21 is rotated in the reverse direction to thereby rotate the pinion 23, axially coupled to the shaft of the door motor 21, so that the upward movement of the rack 25 caused by the pinion 23 moves upward the discharge outlet door 13, and the discharge outlet 7 is thus closed. At this time, when the door closing/opening detection sensors located at both the upper and lower portions of the discharge outlet door 7, detect that the discharge outlet 7 is closed, the door motor 21 stops, and the air conditioner maintains its standby state until the operation key is again ON.

However, there is a problem in that in case power failure occurs during either a closing or opening operation of the discharge outlet door 13, the deactivated motor causes the discharge outlet door 13 to be immobile immediately at a position thereof. Since information regarding the position of the discharge outlet door 13 is not available even after recovery of the required power, the discharge outlet door 13 may remain opened even in the standby state of the air conditioner.

SUMMARY OF THE INVENTION

Therefore, it is an object of the present invention to provide a suction inlet/discharge outlet opening or closing apparatus for an air conditioner whose a suction grille and discharge outlet can be fully closed after recovery of electric power, based upon a measured opening or closing time duration of a suction inlet and discharge outlet until power failure occurs, for preventing dust and/or foreign substances from passing through the suction inlet and the discharge outlet into a main body during the standby state of the air conditioner, and a method therefor.

The above objects are accomplished by an air conditioner having an apparatus for closing or opening a suction inlet/discharge outlet to prevent undesirable introduction of any dust and/or foreign substances into the air conditioner, the air conditioner further having a suction inlet for taking in room air, a heat-exchanger for heat-exchanging the air sucked through said suction inlet, and a discharge outlet for discharging a heat-exchanged air through the heat-exchanger, said apparatus comprising:

a suction grille for opening and closing said suction inlet so as to prevent undesirable introduction of any dusts or foreign substances through the suction inlet;

voltage sensing means for detecting input voltage which may be varied during an opening or closing of the suction inlet and discharge outlet;

control means for determining whether or not power failure occurs, based upon the input voltage sensed by the voltage sensing means and controlling the opening or closing of the discharge outlet door and suction grille;

memory means for memorizing a time interval for an opening or closing of the discharge outlet door and suction grille before the power failure occurs; and driving means adapted to move the discharge outlet door and suction grille only for the time interval stored in the memory means such that the discharge outlet and suction inlet are fully closed.

According to another aspect of the present invention, there is provided a method for closing or opening a discharge outlet of an air conditioner, the method comprising the steps of:

closing/opening a discharge outlet door and suction grille through the control of driving means therefor in response to a start/stop command from operation manipulating means;

determining power failure, based upon the detection of varying input voltage, at the same time, counting a time interval taken to open/close the discharge outlet door and suction grille;

memorizing the count measured until power failure occurs in memory means;

determining if electric power failed is recovered again or not, with reference to a sensed varying input voltage during a period of power failure; and controlling, if the power is recovered, the driving means to fully close the discharge outlet door and suction grille for the time interval stored in the memory means.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

Figure 1:
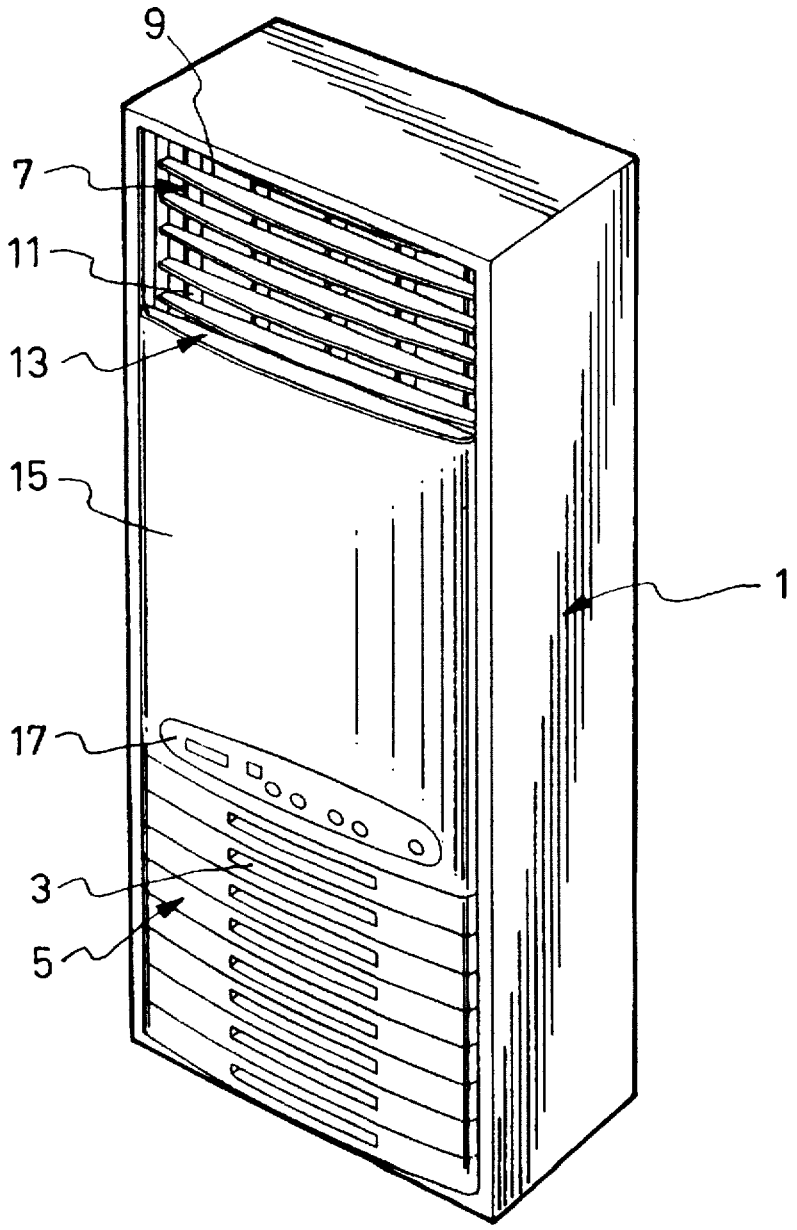
FIG. 1 (PRIOR ART)
FIG. 1 is a schematic perspective view illustrating a conventional air conditioner whose discharge outlet is opened.
Figure 2:
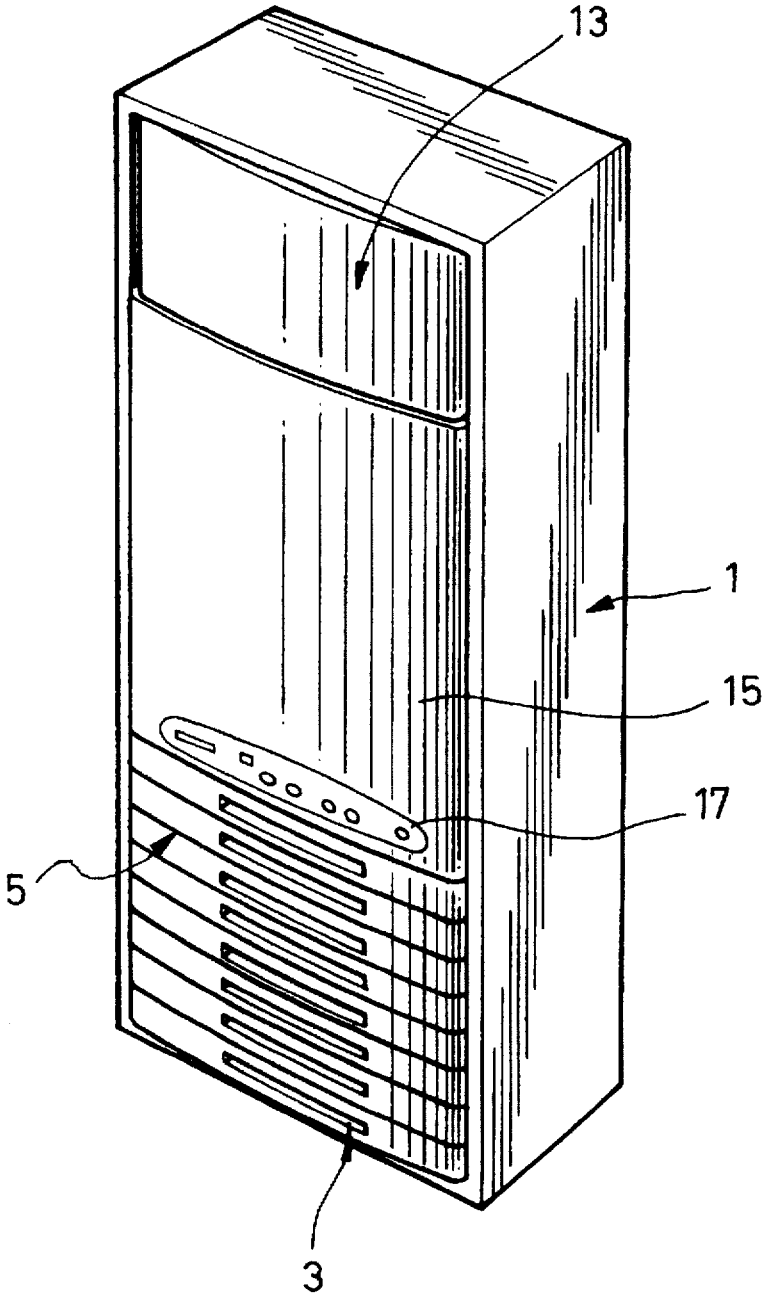
FIG. 2 (PRIOR ART)
FIG. 2 is a schematic perspective view illustrating the conventional air conditioner whose discharge outlet is closed.
Figure 3:
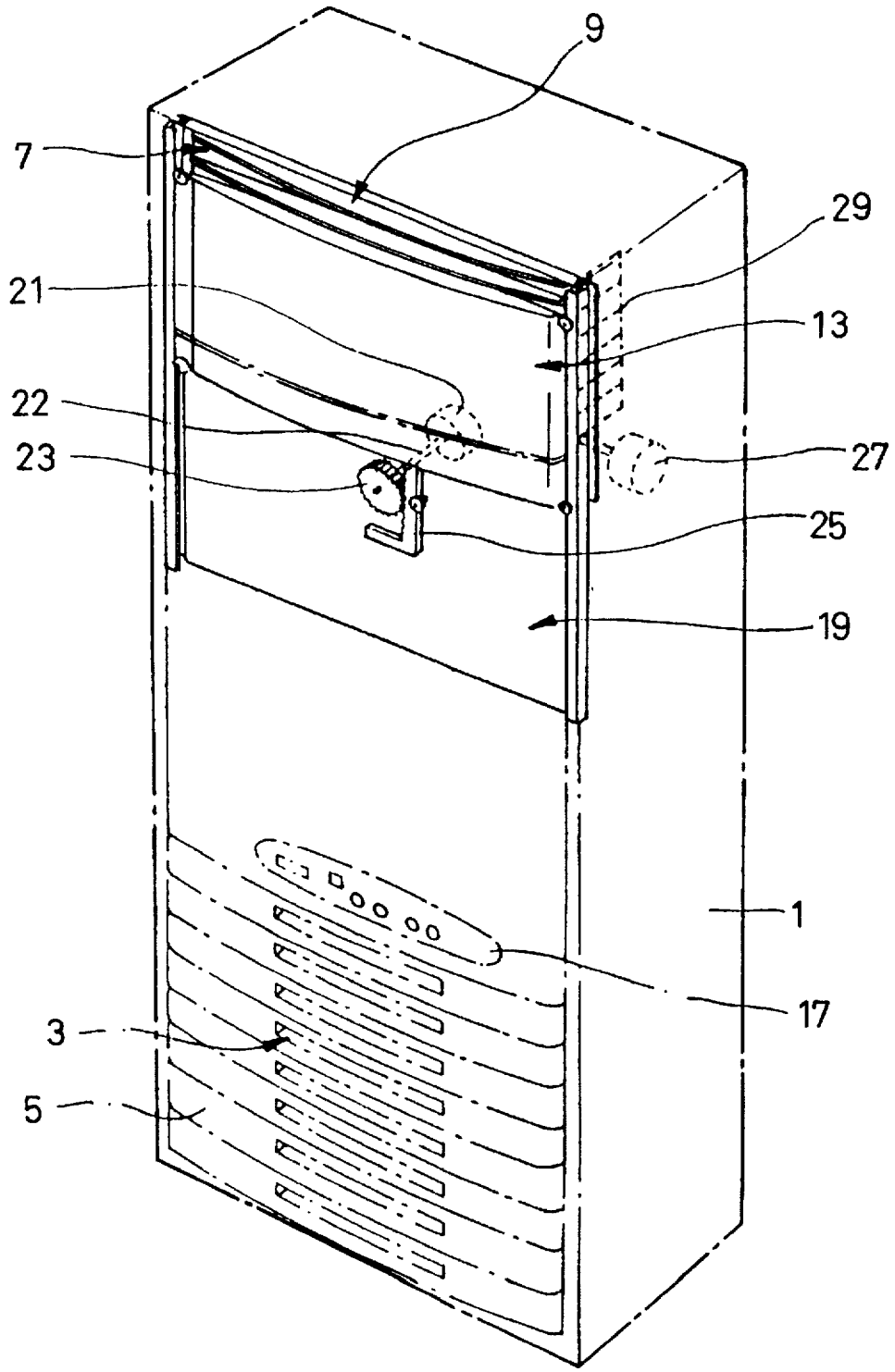
FIG. 3 (PRIOR ART)
FIG. 3 is a schematic perspective view illustrating a structure of the air conditioner.

The preferred embodiment according to the present invention will now be described in detail in accordance with the accompanying drawings. Throughout the accompanying drawings, like parts are designated by like reference numerals or symbols whose further detailed descriptions will be omitted.

Figure 4:
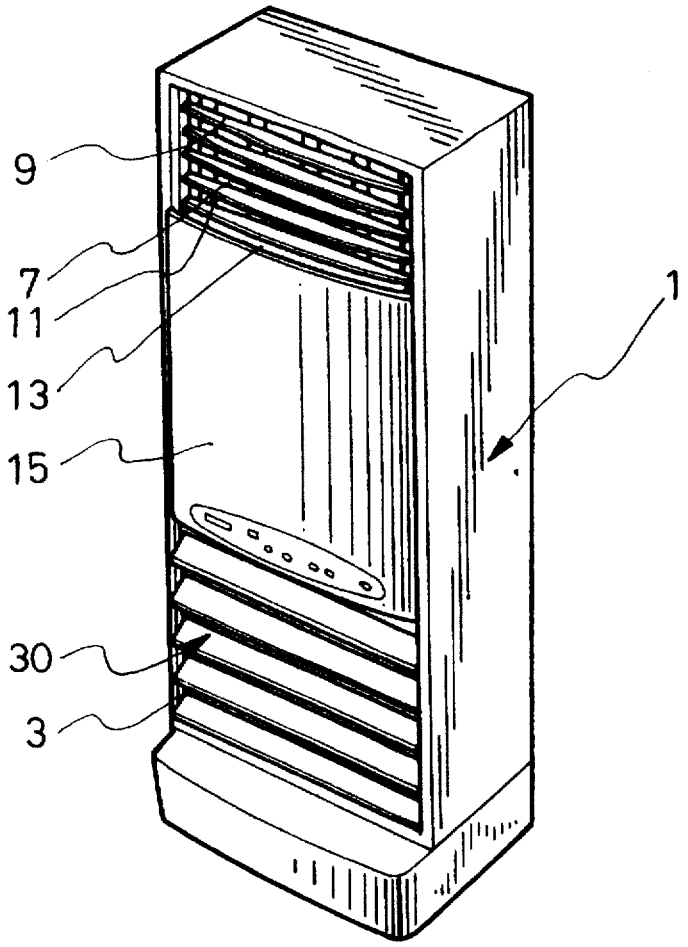
FIG. 4 is a schematic perspective view illustrating an air conditioner in accordance with one embodiment of the present invention.
Figure 5:
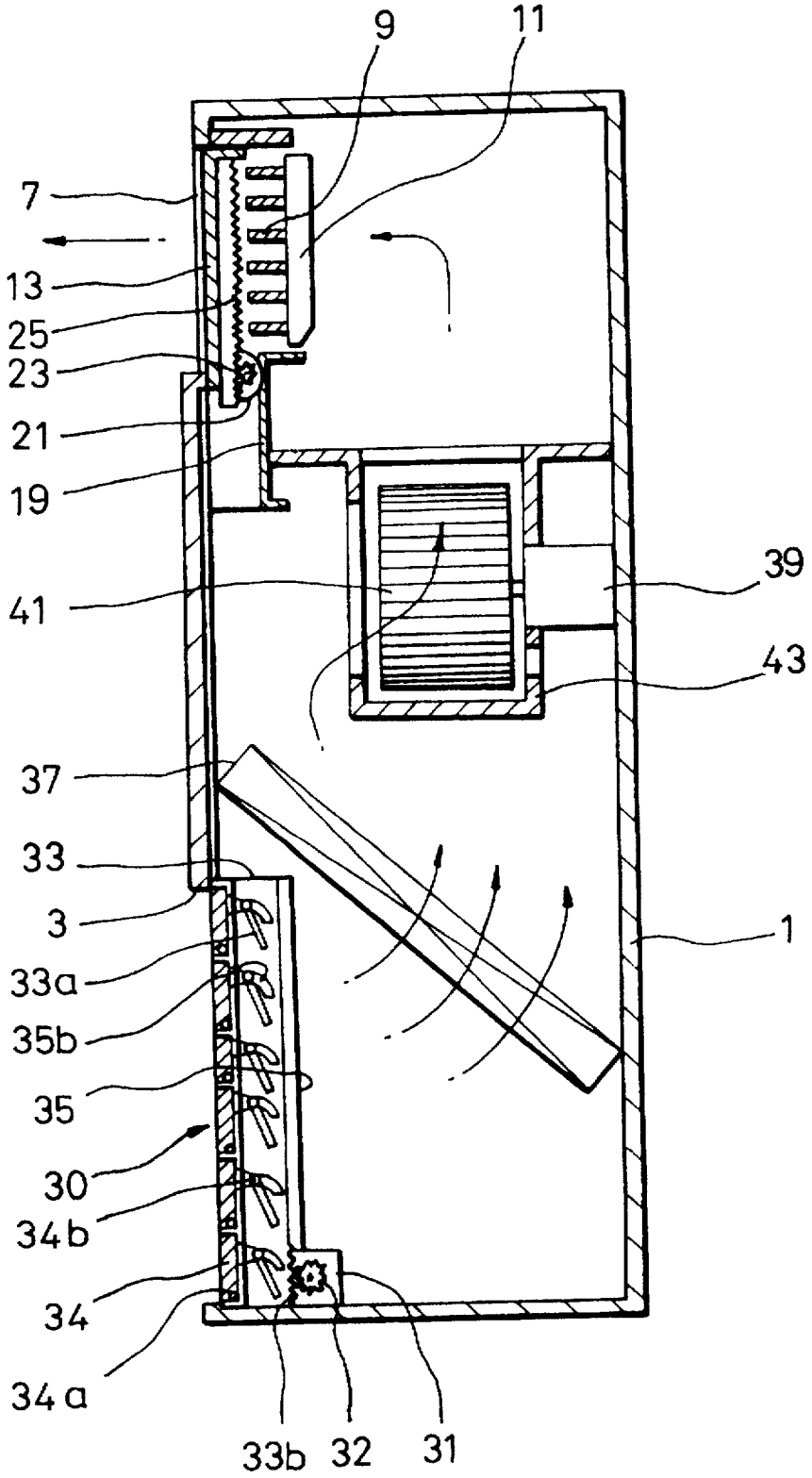
FIG. 5 is a vertical section illustrating the air conditioner whose suction inlet and discharge outlet are closed in accordance with one embodiment of the present invention.

As shown in FIG. 4, a main body 1 has means 30 for opening and closing an suction inlet 3 which draws a room air and prevents any foreign substances from being introducing through the suction inlet 3. The means 30 may consist of, as shown in FIG. 5, a motor 31, a pinion 32 rotated in response to the motor 31 action, a slide member 33, a plurality of suction grilles 34 and guide members 35. The slide member 33 is engaged with the pinion 32 and which conducts a linear motion in response to the pinion 32 rotation. The plurality of suction grilles 34 are rotated in response to the linear motion of the slide member 33, thereby closing or opening the suction inlet 3. The guide members 35 are located at both ends of each suction grille 34, and coupled to be rotated relative to the stationary suction grille 34 and to provide the opening and closing of the suction inlet by the guide members rotated.

Also, the means 30 are provided in its rear space inside the body 1 with an oblong-shaped heat exchanger 37 to heat-exchange the room air sucked through the suction inlet 3, utilizing the evaporation latent heat of the refrigerant, with the desired cold or warm air. Over the heat exchanger 37 is provided a blower fan 41 (hereinafter referred to as an indoor fan) for sucking the room air through the suction inlet 3 and also discharging indoors the heat-exchanged air through the discharge outlet 7. Further, around the indoor fan 40 is installed a duct member 41 covering the indoor fan 40 and guiding the air flow direction from the suction inlet 3 to the discharge outlet 7.

Figure 6:
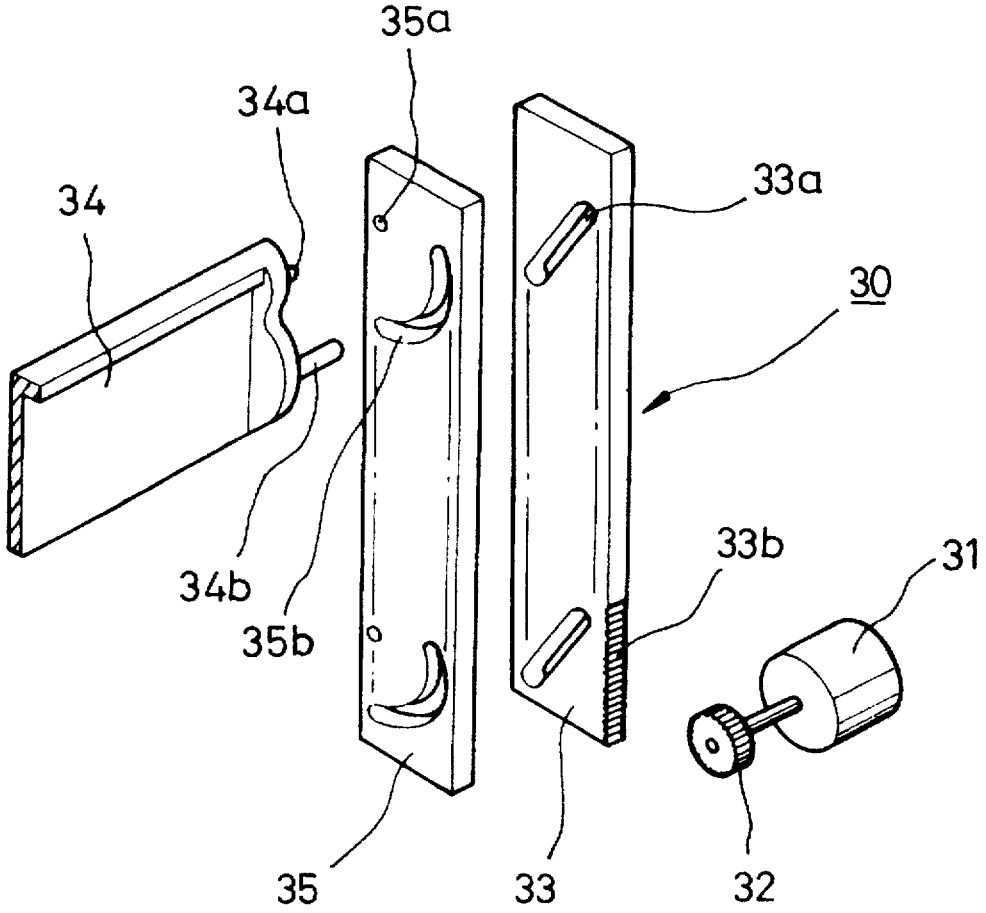
FIG. 6 is an assembly diagram for the main components in accordance with the present invention.

As shown in FIG. 6, the suction grille 34 has at both ends thereof two projections, namely, the first projection 34*a* serving as a hinge axis for a rotary motion of the suction grille 34 with respect to the guide member 35 and the second projection 34*b* inserted into a slot 33*a* formed within the slide member 33 and serving to cause the rotary motion of the suction grille 34 in response to a linear action of the slide member 33.

The guide member 35 is provided with a hole 35*a* receiving the first projection 34*a*, and a guide arc hole 35*b* only through which the second projection 34b is rotated during a linear motion of the slide member 33. Further, the slide member 33 has a rack 33*b* engaged with the pinion 32.

Figure 7:
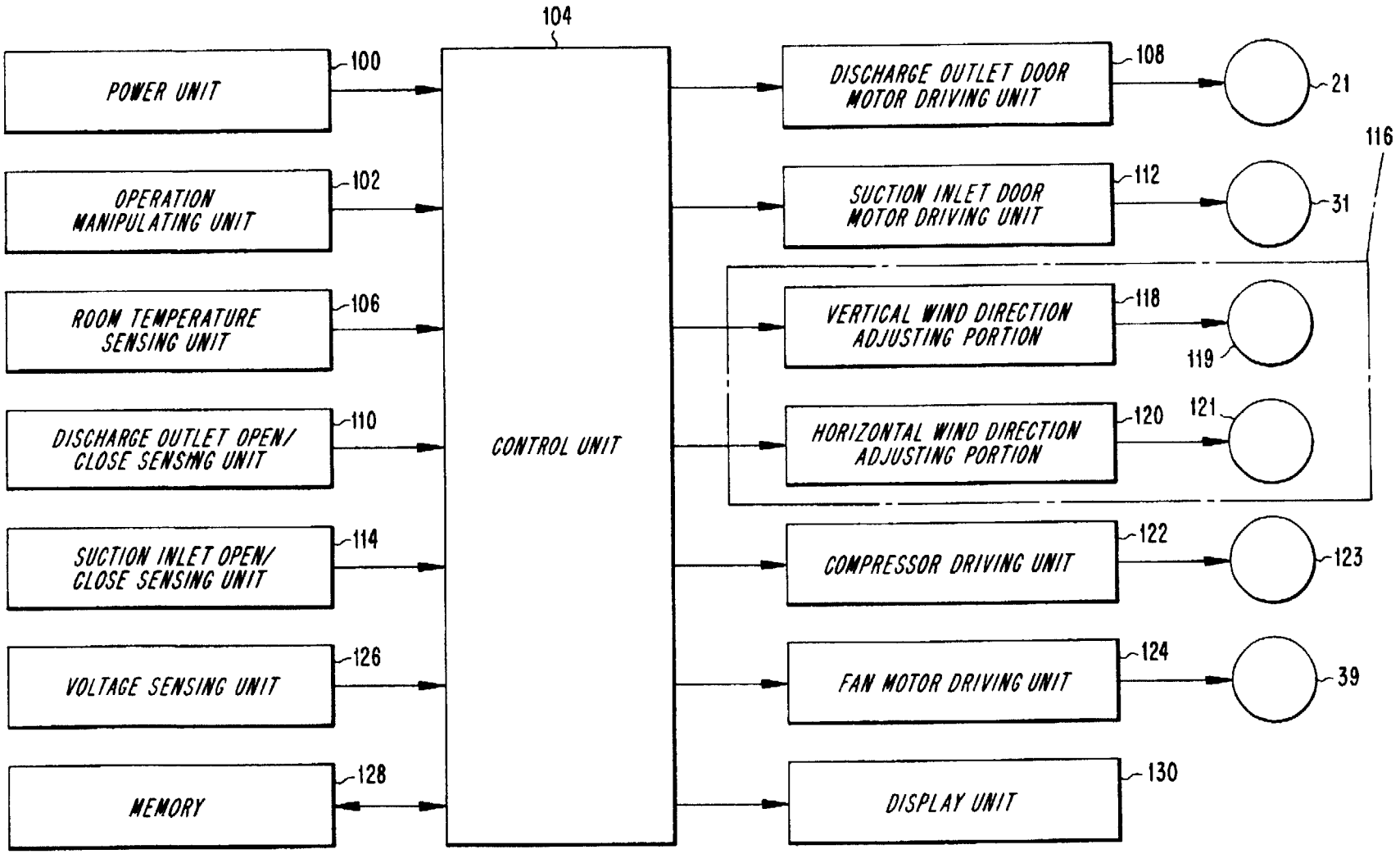
FIG. 7 is a control block diagram of the discharge outlet opening or closing apparatus for the air conditioner according to one embodiment of the present invention.

Next, referring to FIGS. 7 and 8, electrical circuits for controlling the opening and closing of the discharge door 13 and suction grille 34 will be now described below.

In those figures, power means 100 is used to receive a commercial AC voltage from AC power supply stage 101 and to provide a DC voltage necessary for general operations of the air conditioner. Operation manipulating means 102 serves to establish operating conditions such as heating, cooling, humidifying, blowing operation and the like desired by the user, and a desired temperature (Ts), wind amount and the like, and also has start/stop key (operation key).

Control means 104 is a microcomputer which receives DC voltage output from the power means 100 and initializes the air conditioner, at the same time, controls overall operations of the air conditioner according to the operating conditions applied by the operation manipulating means 102. This control means 104 also controls, based upon an opening or closing time duration of a suction inlet and discharge outlet until power failure occurs, an application of electric power to the motors 21 and 31 such that the discharge outlet door 13 and suction grille 34 are fully closed. It is noted that said time duration may be stored in memory means to be described later.

Room temperature sensing means 106 serves to sense temperature Tr of the room air sucked and to maintain the temperature Ts established by the user. Means 108 for driving the discharge outlet door motor 21 receives a control signal from the control means 104 which is issued under the start and stop command present, and controls the motor 21 related to up/down movements of the discharge outlet door 13.

Also, means 110 for sensing a current position of the discharge outlet door 13 senses the position of the discharge outlet door 13 to determine if the discharge outlet 7 is currently opened or closed, and then sends the result to the control means 104.

Figure 8:
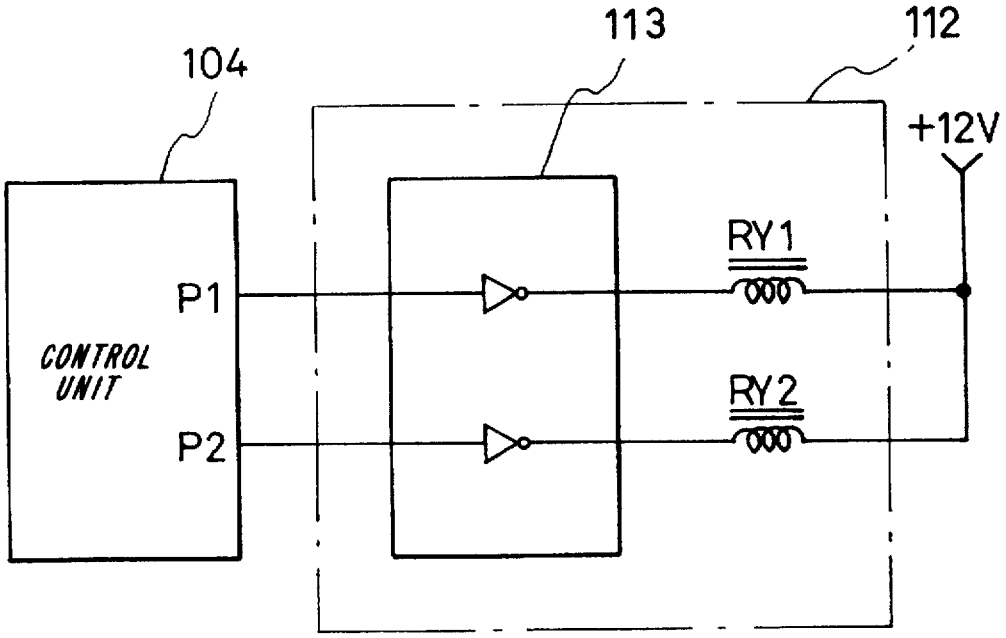
FIG. 8 is a detailed circuit diagram of means for driving a closing or opening of a suction inlet which is applied to the present invention.
Figure 8:
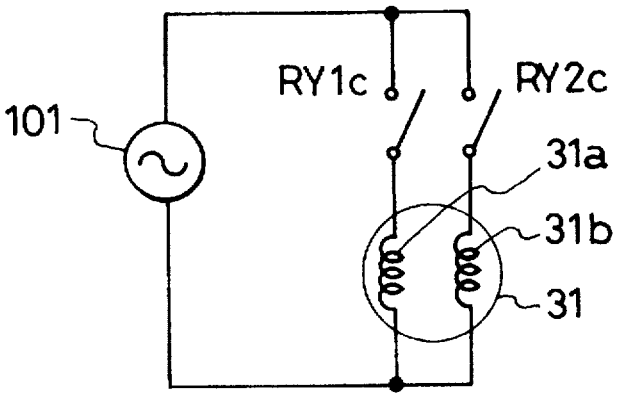

Means 112 for driving the suction inlet door motor 31 receives a control signal from the control means 104 which is output when the start or stop signal is input through the operation manipulating means 102 and controllably drives the suction inlet door motor 31 such that the suction grille 34 used to close and open the suction inlet 3 is moved, wherein the means 112 including, as shown in FIG. 8, an inverter IC 113 functioning to invert high-level signals which are output from output terminals P1, P2 of the control means 104 as signals for controlling the closing and opening of associated door, respectively, a first relay RY1 switched, when a low level signal from the inverter IC 113 representing the opening of the door is present, to deliver the received DC voltage of 12 V from the power means 100 to the suction inlet door motor 21 for a forward rotation thereof, and a second relay RY2 switched, when a low level signal from the inverter IC 113 representing the closing of the door is present, to deliver the received DC voltage of 12 V from the power means 100 to the suction inlet door motor 21 for a backward rotation thereof.

There is also provided means 114 for detecting if the suction inlet 3 is opened or not with reference to a current position of the suction grille 23 that has been moved in response to the ascending action of the slide member 33 and then for providing the resultant to the control means 104.

Wind direction adjusting means 116 is provided such that the air is evenly supplied in the room, and consists of vertical wind direction adjusting portion 118 which drives a motor 119 to move upward/downward the vertical blades 9 when required by a control signal from the control means 104, and horizontal wind direction adjusting portion 118 which drives another motor 121 to move right/left the horizontal blade 11 when required by another control signal from the control means 104.

Compressor driving means 122 drives the compressor 117 in response to the control signal from the control means 104 when a difference between the set temperature Ts and the room temperature Tr, detected by the room temperature sensing means 106, exists, and the fan motor driving means 124 drives the indoor fan 41 by controlling revolution of the indoor fan motor 39 in response to a control signal from the control means 104, for blowing indoors the air heat-exchanged by the heat exchanger 37.

Also, in the drawing, voltage sensing means 126 acts to sense a DC voltage level supplied from the power means 100 and then provide it to the control means 104 which in turn, based upon the sensed information, determines if or not power failure occurred during the opening or closing operation of the suction inlet 3 and discharge outlet 7, or if or not the power is recovered again. Memory means 128 memorizes a time interval from the closing or opening of the suction inlet 3 and discharge outlet 7 to a power failure occurrence, and the stored content of which is read out through a buffer(not shown) to an input/output port which the control means 104 has, when the necessary power is recovered again. In implementation of the memory means 128, EEPROM may be employed for such operations.

Display means 130 displays, under the control of the control means 104, the selected operation mode (automatic mode, cooling, heating, defrost, air-cleaning, and so forth, of the air conditioner) applied from the operation manipulating means 102, and the room and established temperatures Tr and Ts, as well as the operation conditions of the air conditioner.

The operation and advantages of a suction inlet/discharge outlet closing and opening apparatus for the air conditioner and method therefor will be described.

Figure 9A:
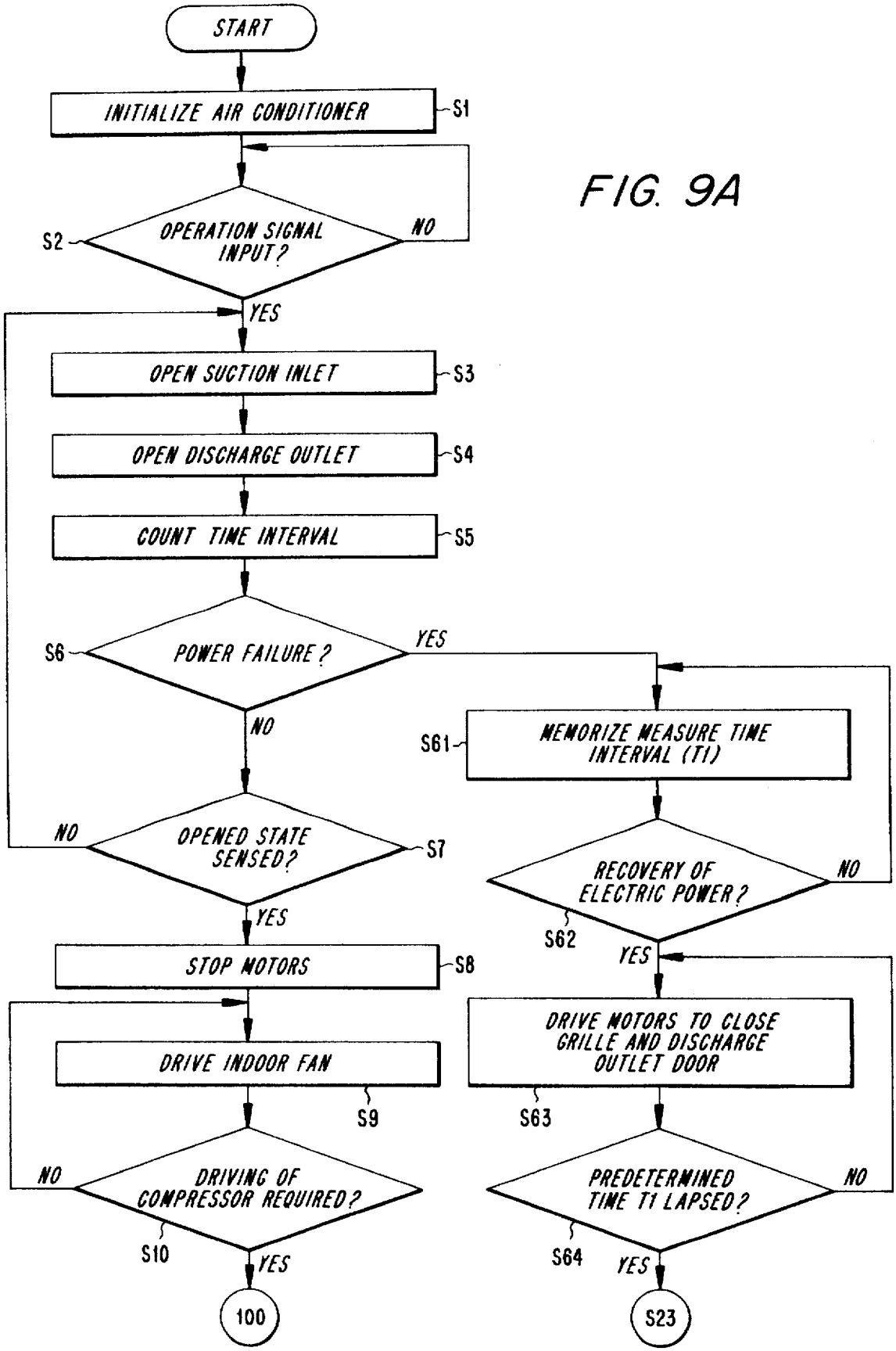
FIGS. 9A to 9C are flow charts illustrating sequential control procedures for opening or closing the discharge outlet of the air conditioner.
Figure 9B:
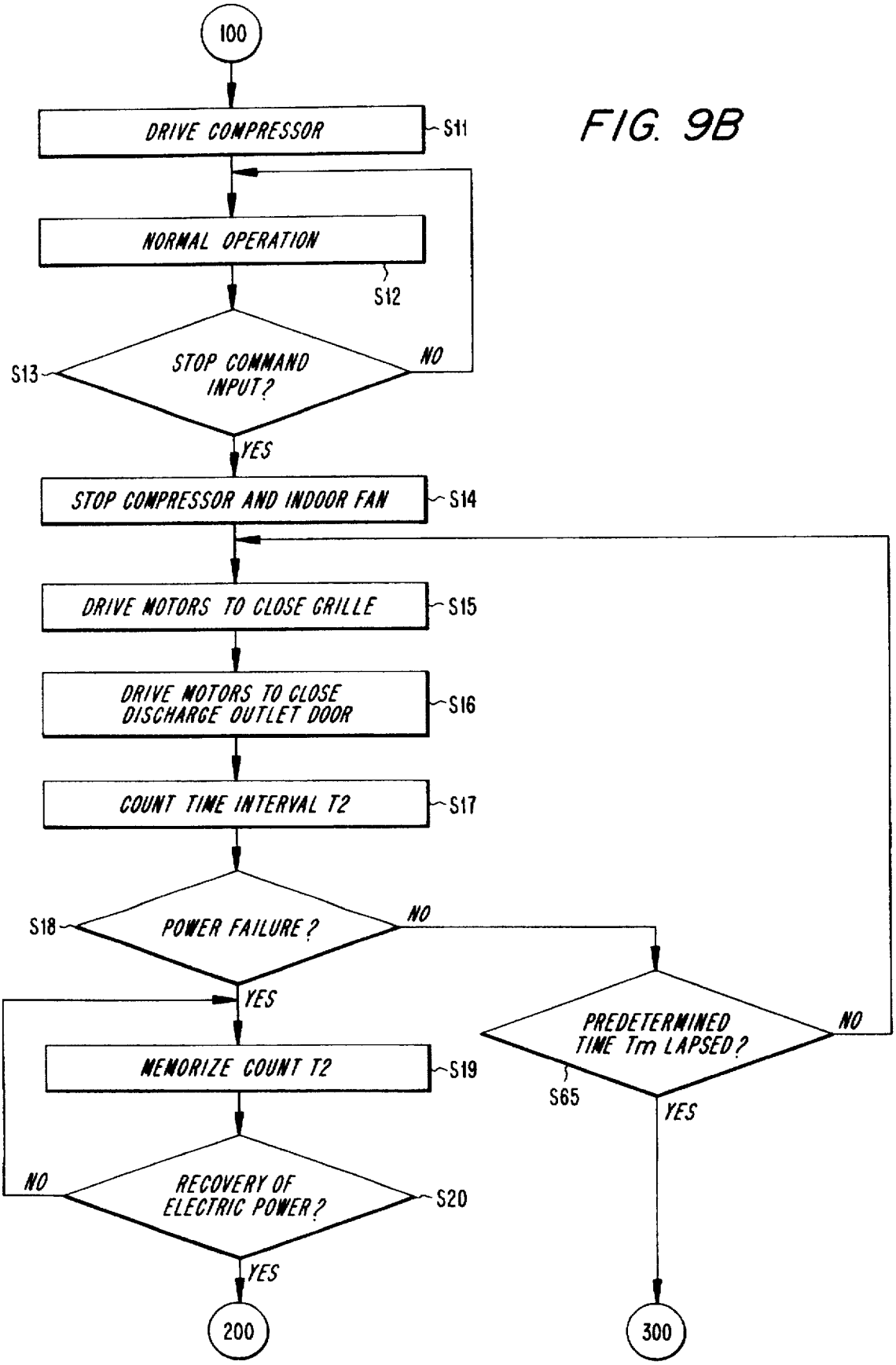
Figure 9C:
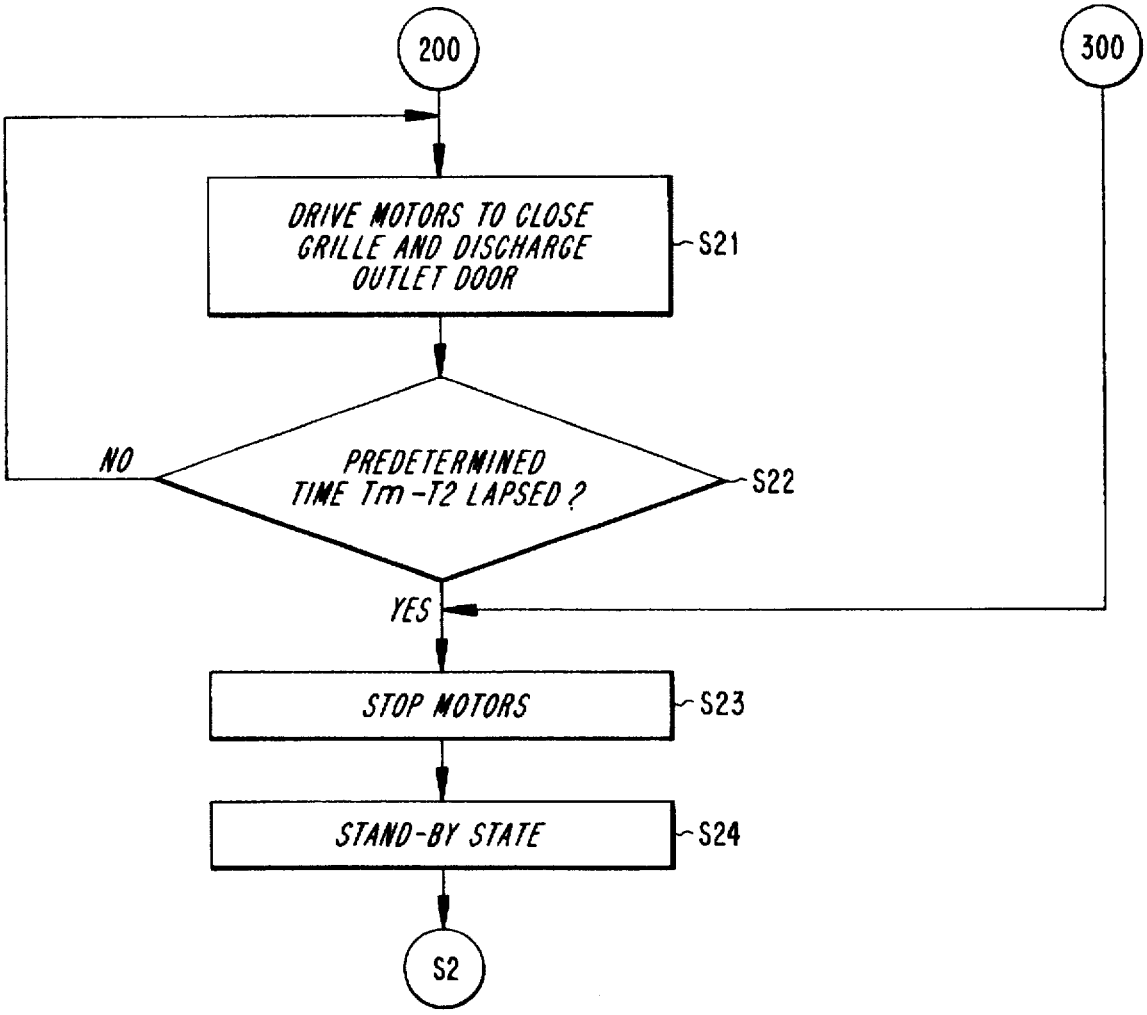

FIGS. 9A and 9C are flow charts illustrating sequential control procedures for opening or closing the suction inlet/discharge outlet of the air conditioner.

It is now assumed that the discharge outlet 7 and the suction inlet 3 remain closed as an initial condition for the purpose of the explanation.

First, when electric power is applied to the air conditioner, the power means 100 performs such that a commercial AC power supplied from an AC power stage (not shown) is converted into a DC voltage with a voltage level required to activate the air conditioner. The DC voltage obtained is applied to the control means 104 and each of the driving circuits.

When a DC voltage from the power means 100 is applied to the control means 104, the air conditioner is initialized by the control means 104(S1).

If a user sets the desired operational mode and a temperature Ts, and then depresses an operation key, an operation selection signal and operation start signal(hereinafter, referred to as an operation signal) from the operation manipulating means 102 are applied to the control means 104.

Thus, at step S2, the control means 104 determines whether the operation signal is applied or not. If not(in the case of NO), the. control means 104 maintains a standby mode of the air conditioner and repeats step S2.

If the operation signal is input(in the case of Yes), the process advances to step S3 in which the control means 104 outputs the control signal of high level to the means 112 through an output terminal P1 thereof as an open command so as to open the suction inlet 3. Accordingly, the open command of low level from associated inverter IC 113 causes a contact point RY1*c* of the relay RY1 to be in a closed state.

During the closed state of the contact point RY1*c* of the relay RY1, an AC voltage from the AC power supply stage 101 is applied to winding 31*a* of the suction inlet door motor 31. Then, the motor 31 starts to rotate, which allows the opening of the suction inlet 3 according to the operational procedures as described earlier with reference to FIG. 6, and details of which will be therefore omitted.

At step S4, the control means 104 outputs a control signal conveying an open command for the discharge outlet 7 to the means 108. When the motor 21 is activated, the organic operations of the motor 21, the pinion 23, the rack 25 and the discharge outlet door 12 associated with the rack 25 are made. The discharge outlet 7 can be opened accordingly.

However, it should be noted that the above opening operations of both discharge outlet door 13 and suction grille 23 are made simultaneously.

At this time, the control means 104 counts a time interval TI of the openings of both doors(S5), and, at the same time, the voltage sensing means 126 continues to detect voltage V from the power means 100 and to report it to the control means 104. The control means 104 compares a reference value V previously established therein with the reported value and determines if the level of the sensed value is lower than that of the reference value and if or not the power failure occurs with reference to the comparison result (S6).

In case of no power failure (No answer at step S6), the process goes to step S7 where the two means 110 and 114 detect current positions of the discharge outlet door 13 moved downward and the slide member 33 moved upward, respectively.

The control means 104 determines, based upon the sensed signals from both said means 110 and 114, if the discharge outlet door 13 and suction grille 34 are opened. The loop from steps S3 to S7 is repeated until the door 13 and suction grille 34 are opened. If at the decision step S7, it is 25 determined that the door 13 and suction grille 32 are opened(in the case of YES), the process proceeds to step 8 in which the means 108 stops the discharge outlet motor 21 tinder the control of the control means 104 so as to complete the opening operation of the discharge outlet door 13. The means 112 also stops driving the suction inlet motor 31 in response to the open command of low level which is output from the control means 104 through the output terminal P1 thereof, for completing the opening operation of the suction grille 34.

Then, at step S9, the fan motor driving means 124 drives the indoor fan 41 and controls revolution thereof under the control of the control means 104. The driven indoor fan 41 sucks the room air into the body 1, and temperature Tr of the air sucked is sensed by the room temperature sensing means 106.

Subsequently, it is determined whether or not conditions for driving the compressor are met, referring to the comparison between the sensed room temperature Tr and the established temperature Ts, wherein said conditions refer to one case that the sensed temperature is of higher temperature than the pre-set temperature by a user with the detection of the room temperature sensing means in a cooling mode of the air conditioner, and the other case that the sensed temperature is of lower temperature than the pre-set temperature by a user in a heating mode, respectively.

If it is determined as being independent of the compressor driving conditions(in the case of NO) at step S10, the process returns to step S9 and then continues to detect the room temperature. If it is determined that the answer is positive, the process advances to step S11, in which the control means 104 defines the operational frequency necessary for the driving of the compressor 123 based upon the difference between both temperatures Tr and Ts and then outputs a control signal suitable for driving the compressor 123 to the compressor driving means 122. The activation of the compressor implies a normal operation by the air conditioner.

During such a normal operation, the stop key may be depressed in step S13. If so, the process goes through step S13 to step S14 where the control means 104 outputs a control signal for stopping the compressor 123 and indoor motor 39 to the compressor driving means 122 and fan motor driving means 124. Once the stop command is issued, the suction inlet 3 and discharge outlet 7 should be closed. To this end, the control means 104 outputs a control signal of high level to the means 112 through the output terminal P2 thereof to close the suction inlet 3. The output signal is inverted by the inverter IC 113 and then a low level signal is produced which causes the contact point RY2*c* of the relay RY2 to be closed. This occurrence implies that the AC voltage from the AC power stage 101 is applied to winding 31*b* of the suction inlet motor 31. The backward rotation of the suction inlet motor 31 allows the suction inlet 3 to be closed with organic operations of assembled parts as shown in FIG. 6. Also, the backward rotation of the discharge outlet motor 31 upwardly moves the discharge outlet door 13, coupled to the pinion 23, to close the discharge outlet 7.

At this time, at step S17, the control means 104 starts to count a time interval taken during the closing of the discharge outlet door 13 and suction grille 34, and at the same time, the voltage sensing means 126 detects the DC voltage level from the power means 100 and then outputs it to the control means 104 which compares the sensed voltage with a constant reference voltage Vs level previously set therein in order to see whether or not power failure occurs.

In case of power failure, the sensed voltage V being lower than the reference voltage Vs, the process goes to step S19 in which the control means 104 memorizes the counted duration of the time interval T2 in the memory means 128 and determines the recovery of electric power through the comparison of a previously set constant reference voltage Vs and a sensed DC voltage V to be supplied from the power means at step S20.

Steps S19 and 20 are repeated until the required power is entered again. In case that the power is applied again, the DC voltage V higher than the reference voltage Vs, allowing the process to further go step S21 where the control means 104 again outputs the control signal to both means 108 and 112 so as to fully close the discharge outlet door 13 and suction grille 23 which have been stationary for power failure period.

At this time, at step S22, it is determined that the control means counts the driving time for the discharge outlet motor 21 and suction inlet motor 31 when closing the discharge outlet door and suction grille and determines if a predetermined time interval(obtained from the subtraction of a time Tm taken to fully close both the discharge outlet door and suction grille from the time interval T2 stored in the memory means, i.e., Tm-T2) lapses or not, if not, the process returns to step S21 where the discharge outlet motor 21 and suction inlet motor 31 are continuously driven until the discharge outlet door 13 and suction grille 34 are fully closed.

After the predetermined time interval Tm-T2 has lapsed (in the case of YES), it is determined that it is fully closed, then advances to step S23 where suction inlet motor 31 is deactivated by the means 112 in response to a control signal of low level carrying a close command from the control means through the output terminal P2 of the control means 104, thereby to complete the closing of the suction grille 34. Then, the means 108 stops driving the discharge outlet motor 21 under the control of the control means 104 to complete the closing of the discharge outlet door 13.

Next, at step S24, the control means 104 maintains the standby of the air conditioner until the start command from the operation manipulating means 102 is input again, and the process is returned to step S2.

Meanwhile, when the sensed DC voltage V by the voltage sensing means 126 is lower than the constant reference voltage Vs, which implies power failure occurrence(in the case of YES), the process goes to step S61 where time interval T1, having been countered during the opening of the discharge outlet door 13 and suction grille 34, is memorized in the memory means 128 through the input/output port.

Steps S61 and 62 are repeated until the required power is entered again.

In the case where the power is applied again, the DC voltage V being higher than the reference voltage Vs, allows the process to further go step S63 where the control means 104 again outputs the control signal to both means 108 and 112 so as to fully close the discharge outlet door 13 and suction grille 34 which have been stationary for the power failure period.

At this time, at step S64, it is determined that the control means 104 counts the driving time for the discharge outlet motor 21 and suction inlet motor 31 when closing the discharge outlet door and suction grille, and determines if a predetermined time interval T1 stored in the memory means lapses or not, if not, the process returns to step S63 where the discharge outlet motor 21 and suction inlet motor 31 are continuously driven until the discharge outlet door 13 and suction grille 34 are fully closed.

After the predetermined time interval T1 has lapsed (in the case of YES), it is determined to be fully closed, then advances to step S23.

Also, in case of no power failure at step S18 (in the case of NO), the process advances to step S65 where the control means 104 counts the closing time intervals of the discharge outlet motor 21 and suction inlet motor 31, and determines if or not a predetermined time interval Tm, i.e., time taken to fully close the discharge outlet door and suction grille, has lapsed, if not yet, the process returns to step S15 where the discharge outlet motor 21 and suction inlet motor 31 are continuously driven until the discharge outlet door 13 and suction grille 34 are fully closed. After the predetermined time interval Tm has lapsed (in the case of YES), it is determined to be fully closed, then advances to step S23.

According to the discharge outlet opening or closing apparatus for the air conditioner and the associated method therewith in accordance with the present invention, there is provided that the doors are fully closed even after recovery of electric power, although power failure has occurred when the doors are closing. Therefore, undesirable introduction of any dust and foreign substances into the body can be prevented.

What is claimed is:

1. An air conditioner having an apparatus for closing or opening a discharge outlet of a function to prevent undesirable introduction of any dust or foreign substances into the air conditioner, the air conditioner further having a suction inlet for taking in a room air, a heat-exchanger for heat-exchanging the air sucked through said suction inlet, and a discharge outlet for discharging a heat-exchanged air through the heat-exchanger, said apparatus comprising:

a suction grille for opening and closing said suction inlet so as to prevent undesirable introduction of any dust or foreign substances through the suction inlet;

voltage sensing means for detecting input voltage varied during an opening or closing of the suction inlet and discharge outlet;

control means for determining whether or not power failure occurs, based upon the input voltage sensed by the voltage sensing means and for controlling the opening or closing of the discharge outlet door and suction grille, memory means for memorizing the time interval for an opening or closing of the discharge outlet door and suction grille before the power failure occurs; and driving means adapted to move the discharge outlet door and suction grille only for the time interval stored in the memory means such that the discharge outlet and suction inlet are fully closed.

2. The apparatus as defined in claim 1, wherein the control means determines that power failure occurred when the input voltage sensed by the voltage sensing means is lower than a reference voltage previously set therein.

3. The apparatus as defined in claim 1, wherein the control means determines no power failure or recovery of the electric power failed when the input voltage sensed by the voltage sensing means is higher than a reference voltage previously set therein.

4. The apparatus as defined in claim 1, wherein the control means controls the closing of the discharge outlet door and suction grille when electric power is recovered, with a time interval during the driving of the driving means counted.

5. A method for closing or opening a discharge outlet of an air conditioner, the method comprising the steps of:

closing/opening a discharge outlet door and suction grille through the control of driving means therefor in response to a start/stop command from operation manipulating means;

determining power failure, based upon the detection of the varying input voltage, at the same time, counting a time interval taken to open/close the discharge outlet door and suction grille;

memorizing in a memory means the count measured until power failure occurs;

determining if electric power failed is recovered again or not, with reference to a varying input voltage sensed during a period of power failure; and controlling, if the power is recovered, the driving means to fully close the discharge outlet door and suction grille for the time interval stored in the memory means.

6. The method as defined in claim 5, wherein if the power failure occurs during an opening of the discharge outlet door and suction grille, the discharge outlet door and suction grille are, when the electric power is recovered again, closed for the open time stored in the memory means through a backward rotation of the driving means.

7. The method as defined in claim 5, wherein if the power failure occurs during a closing of the discharge outlet door and suction grille, the discharge outlet door and suction grille are, when the electric power is recovered again, closed by the driving means driven for the time duration obtained by subtracting the close time T2 stored in the memory means from an overall close time Tm.

* * * * *